US009873975B2

(12) United States Patent
Nielsen et al.

(10) Patent No.: US 9,873,975 B2
(45) Date of Patent: Jan. 23, 2018

(54) METHOD OF TRANSFERRING A PIECE OF CLOTH AND A LAUNDRY APPARATUS FOR PERFORMING THE METHOD

(71) Applicant: JENSEN DENMARK A/S, Rønne (DK)

(72) Inventors: Steen Nielsen, Rønne (DK); Henrik Munch Jensen, Nexø (DK); Niels Peter Madsen, Rønne (DK)

(73) Assignee: JENSEN DENMARK A/S, Rønne (DK)

( * ) Notice: Subject to any disclaimer, the term of this patent is extended or adjusted under 35 U.S.C. 154(b) by 0 days.

(21) Appl. No.: 14/495,622

(22) Filed: Sep. 24, 2014

(65) Prior Publication Data

US 2015/0071736 A1 Mar. 12, 2015

Related U.S. Application Data

(62) Division of application No. 12/808,272, filed as application No. PCT/DK2008/000434 on Dec. 16, 2008, now Pat. No. 8,845,259.

(30) Foreign Application Priority Data

Dec. 17, 2007 (DK) ..... 2007 01797

(51) Int. Cl.
*D06F 95/00* (2006.01)
*D06F 67/04* (2006.01)

(52) U.S. Cl.
CPC ..... *D06F 67/04* (2013.01)

(58) Field of Classification Search
CPC ..... D06F 67/04; D06F 63/00; D06C 3/00; D06C 3/12; D06H 3/12; D06B 23/04; B65H 5/085

(Continued)

(56) References Cited

U.S. PATENT DOCUMENTS 2,654,969 A 10/1953 Woodard
3,107,036 A 10/1963 Richards et al.

(Continued)

FOREIGN PATENT DOCUMENTS

DE 38 25 646 A1 2/1990
DE 41 43 070 A1 7/1993

(Continued)

OTHER PUBLICATIONS

International Preliminary Report on patentability dated Feb. 16, 2010 corresponding International Patent Application No. PCT/DK2008/000434.

(Continued)

*Primary Examiner* — Michael McCullough
*Assistant Examiner* — Lynn Schwenning
(74) *Attorney, Agent, or Firm* — Finnegan, Henderson, Farabow, Garrett & Dunner, LLP

(57) ABSTRACT

The invention concerns a method and corresponding apparatus of transferring a piece of cloth from a pair of spreader clamps to a conveyor via a transverse boom, where the piece of cloth is first suspended and straightened between the spreader clamps, then delivered to the transverse boom, and subsequently delivered from the transverse boom to the conveyor. Apart from that, a straightening of the fore edge of the piece of cloth is performed, seen in the direction of conveyance of the conveyor, after its delivery from the clamps to the transverse boom has been initiated, but before it is delivered to the conveyor.

7 Claims, 14 Drawing Sheets

(58) Field of Classification Search
USPC ..... 414/13, 783, 816; 38/143, 7, 8, 10, 12
See application file for complete search history.

(56) References Cited

U.S. PATENT DOCUMENTS

| | | | | |
|---|---|---|---|---|
| 3,247,566 | A | 4/1966 | Burklund | |
| 3,421,756 | A | 1/1969 | Weir | |
| 3,552,743 | A | 1/1971 | Baboz | |
| 3,736,678 | A | 6/1973 | Kamberg | |
| 3,791,057 | A | 2/1974 | Hall | |
| 3,807,068 | A | 4/1974 | Ross | |
| 4,035,878 | A * | 7/1977 | Cheatham ..... | D06C 3/00 162/271 |
| 4,299,521 | A | 11/1981 | Jensen | |
| 4,553,662 | A | 11/1985 | Jensen | |
| 4,586,276 | A | 5/1986 | Kuipers | |
| 5,179,795 | A | 1/1993 | Nakamura et al. | |
| 5,416,992 | A | 5/1995 | Ueda et al. | |
| 5,430,915 | A | 7/1995 | Ueda et al. | |
| 8,234,801 | B2 | 8/2012 | Nielsen et al. | |

FOREIGN PATENT DOCUMENTS

| | | | |
|---|---|---|---|
| DE | 200 09 588 | U1 | 9/2000 |
| EP | 1 160 370 | A2 | 12/2001 |
| EP | 1 820 894 | A1 | 8/2007 |
| JP | 2001-159067 | A | 6/2001 |
| JP | 2007-159921 | A | 6/2007 |
| WO | WO 2007/134601 | A1 | 11/2007 |

OTHER PUBLICATIONS

International Search Report dated Jul. 11, 2008 corresponding Danish Patent Application No. DK 1797/2007.
International Search Report dated Mar. 27, 2009 corresponding International Patent Application No. PCT/DK2008/000434.

* cited by examiner

METHOD OF TRANSFERRING A PIECE OF CLOTH AND A LAUNDRY APPARATUS FOR PERFORMING THE METHOD

This application is a divisional application of U.S. application Ser. No. 12/808,272, §371(c) date of Feb. 25, 2011, which is a National Stage of PCT/DK2008/000434, filed Dec. 16, 2008, and claims the benefit of Denmark PA 2007 01797, filed Dec. 17, 2007, all of which are incorporated herein by reference.

BACKGROUND OF THE INVENTION

The invention relates to a method of transferring a piece of cloth from a pair of spreader clamps to a conveyor via a transverse boom, wherein the piece of cloth is first suspended and straightened between the spreader clamps, then supplied to the transverse boom and subsequently delivered from the transverse boom to the conveyor.

This technique relates to the operation of laundry apparatuses, wherein a large amount of moist pieces of cloth are to be straightened individually and supplied to a conveyor that transfers the pieces of cloth to eg a rotary ironer.

Such known handling of laundry will appear from eg PCT/DK2007/00022

The known technique is associated with the drawback that the fore edge of the clothing, ie the edge that sits foremost on the conveyor, seen in the direction of conveyance thereof, will curve downwards between the spreader clamps even if they are in an extreme position, due to the own weight of the clothing and its water content pulling the clothing downwards. By the known technique, this undesired curve on the fore edge is transferred to the clothing when it is situated on the conveyor and transferred to the rotary ironer, and the most significant drawback of this manifests itself when the clothing is folded following the ironing in which case the end result will have a sloppy or unprofessional appearance.

It is the object of the invention to provide a method for straightening the fore edge of the piece of cloth to the effect that the fore edge will be completely straight when the piece of cloth has been supplied to the conveyer.

SUMMARY OF THE INVENTION

This object is obtained by an alignment of the fore edge of the piece of cloth being performed, seen in the direction of conveyance of the conveyor, following initiation of the delivery from the clamps to the transverse boom, but before it has been supplied to the conveyor.

The alignment can be provided in two different ways, on the one hand by time-controlling the mutually movable parts and, on the other, by a change of shape of some of the mutually movable parts. The preferred embodiments of the invention are exercised either by the transverse boom being moved in the direction of said direction of conveyance during the period of time when the clothing is delivered from the spreader clamps to the transverse boom, or by the transverse boom being provided with a supporting area; and that the shape of that area is changed after the piece of cloth has been supplied to the transverse boom, but before it is supplied to the conveyor. The transverse boom can be configured in one piece or may be divided into sections, eg three or more.

The invention also comprises a first apparatus for exercising the method and comprising a conveyor and comprising a pair of spreader clamps for receiving a pair of adjacent corners of a piece of cloth and for spreading the piece of cloth and for supplying it onto a transverse boom that extends transversally to the direction of conveyance of the conveyor and is shiftable in the latter direction.

The apparatus is characterised in that the apparatus comprises a control unit which is configured for controlling, on the one hand, the spreading movement of the spreader clamps and, on the other, the shifting of the transverse boom in the direction of the direction of conveyance of the conveyor in concordance with a pattern of movement which is stored in the control unit. The pattern of movement may have all degrees of complexity—from a simple linear course to a complex movement that depends on time, a number of sensors for detecting the shape of the clothing as well as on further parameters, if any.

The invention also comprises another apparatus of the kind just related which is, according to the invention, characterised in that the transverse boom comprises an alignment profile that extends essentially in parallel with a movement path for the spreader clamps a distance lower than the spreader clamps, which alignment profile comprises a form-changeable support area for a rim area of the piece of cloth and comprises means for temporarily retaining the piece of cloth.

The means according to the latter apparatus may be combined with the means in the first apparatus for obtaining a completely straight fore edge of the piece of cloth.

It is noted that the undesired downwardly curving part of the piece of cloth known from the prior art is very difficult to calculate in advance, it depending on the elasticity and weight of the clothing and the amount of water absorbed by the clothing. Therefore, in some cases, it will not be possible to accurately calculate in advance the mutual time-control of the machine parts or the shape-change of the alignment profile; rather one would operate with a number of fixed settings that an operator can choose from. In practice, a series of typically largely identical pieces of cloth will be run, and, in the course of a fairly small number of test runs, the method and the apparatus according to the invention will be adjusted to achieve a completely straight fore edge. However, the invention also encompasses that means may be provided for detecting the shape of the fore edge and for setting the time control and/or the form change of said machine parts in such a way as to dynamically compensate for the unintended, downwardly curving part of the piece of cloth.

The transverse boom has means for retaining the piece of cloth. Those means may be mechanical, but typically they are vacuum means which is why the transverse boom will also be designated a vacuum boom.

According to one embodiment, the vacuum boom is flexible transversally to its own plane, which may be accomplished eg by curving the central part of the boom upwards, whereby the major and freely suspended part of the piece of cloth is lifted to compensate for the downwardly directed curve. Alternatively, the central part of the boom is curved downwards before the piece of cloth is delivered from the clamps. When the central part is subsequently curved back to its resting position, the fore edge of the piece of cloth becomes aligned.

According to another embodiment, the vacuum boom is shape-changeable in its own plane, which, according to one embodiment, can be accomplished by the boom being divided into two or more sections that are connected to each other by means of hinges and are carried and controlled by mechanisms configured therefor.

The more water absorbed by the clothing, the heavier it is, and the deeper is the curve formed when suspended between the spreader clamps. It is therefore an advantage to be able to adjust the form-changeability, and hence, according to one embodiment, detector means may be provided for detecting the shape of the edge of the piece of cloth before—during—and/or after it is transferred from the spreader clamps to the boom.

BRIEF DESCRIPTION OF THE DRAWINGS

The invention will be explained in further detail in the description that follows of a number of embodiments, reference being made to the drawing, wherein

FIGS. 7 and 8 show an alternative embodiment of the invention; while

DETAILED DESCRIPTION OF THE INVENTION

Figure 1:
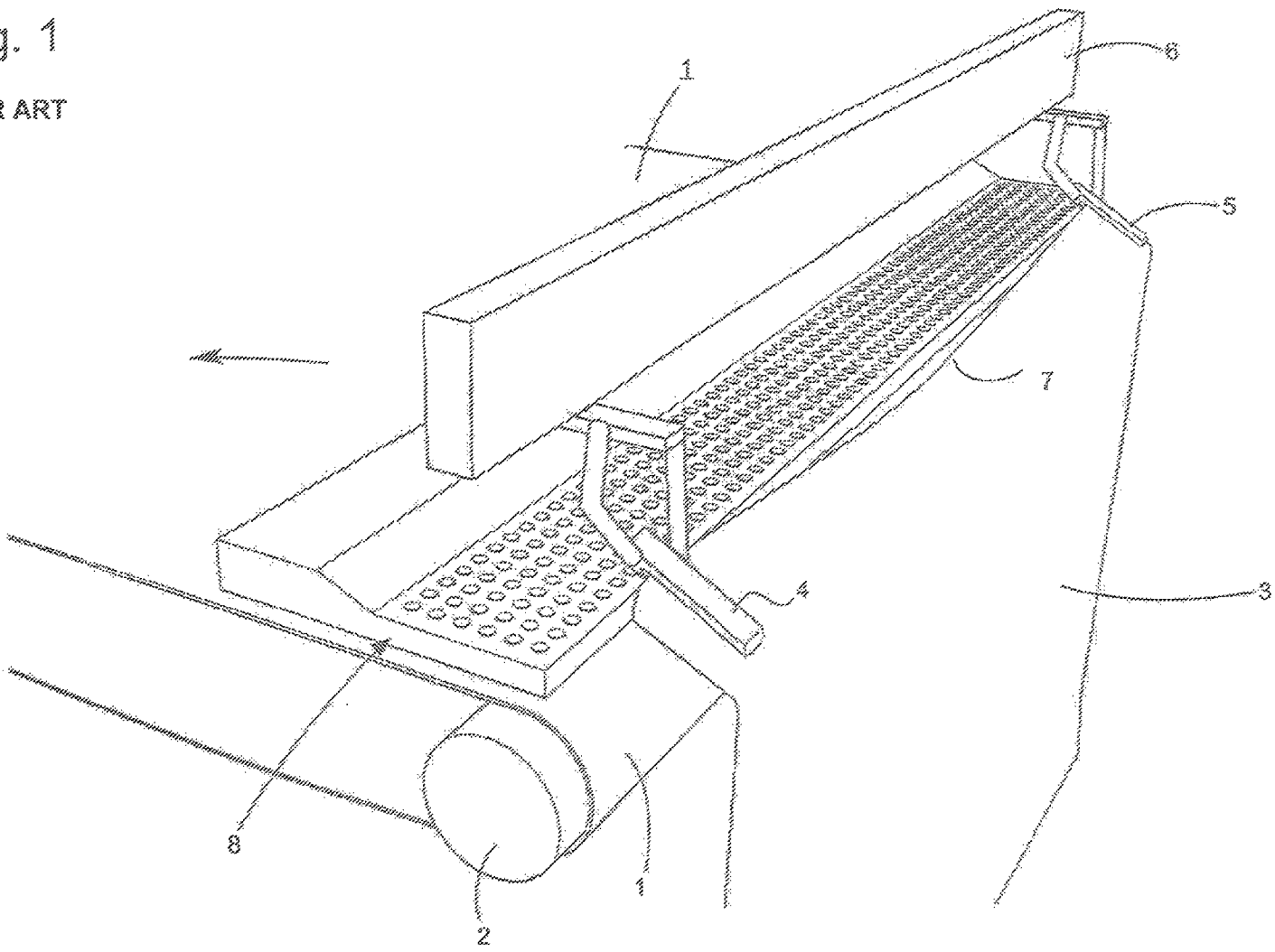
Fig. 1 PRIOR ART
FIGS. 1-3 illustrate the prior art.
Figure 2:
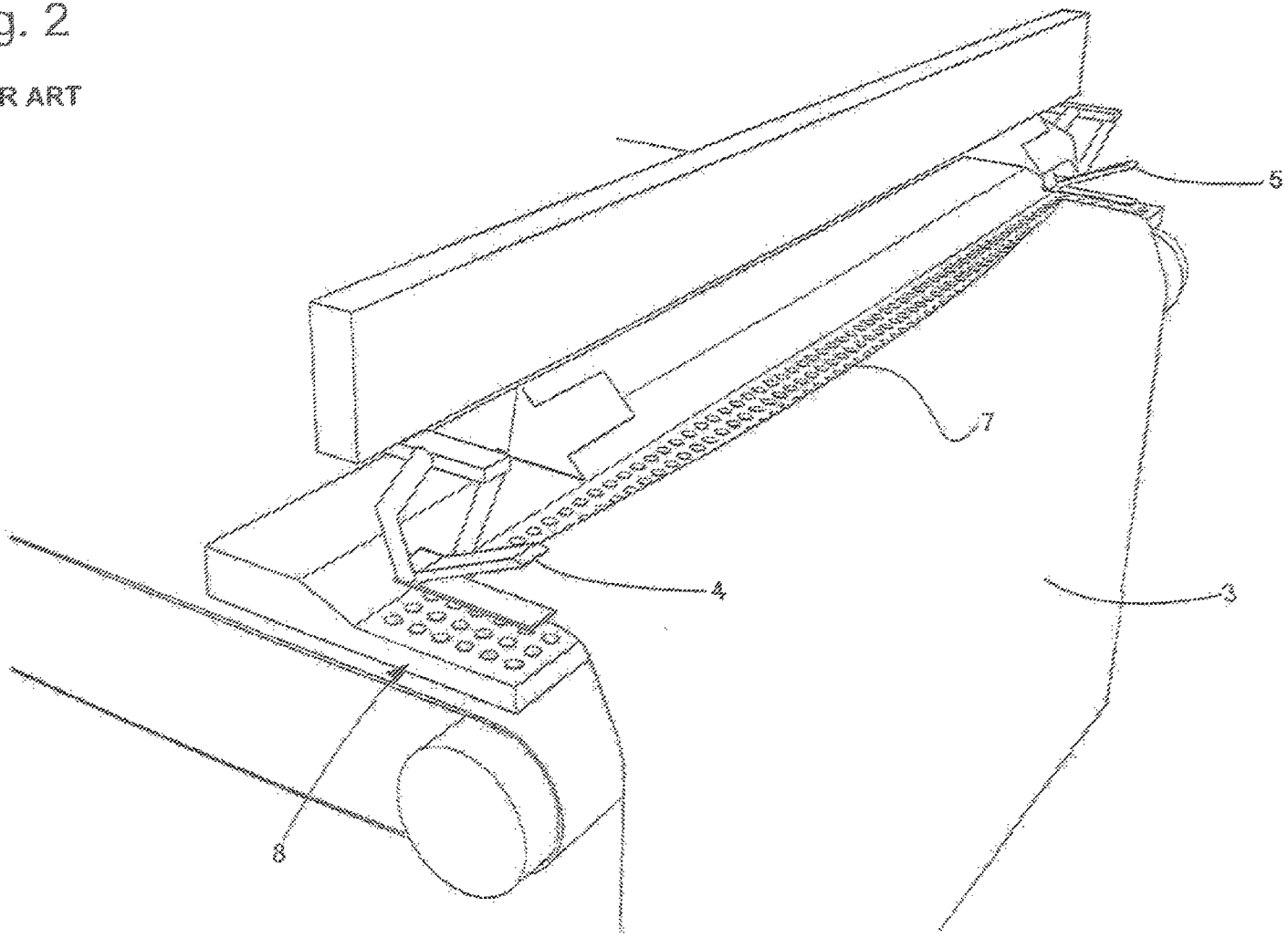
Fig. 2 PRIOR ART
Figure 3:
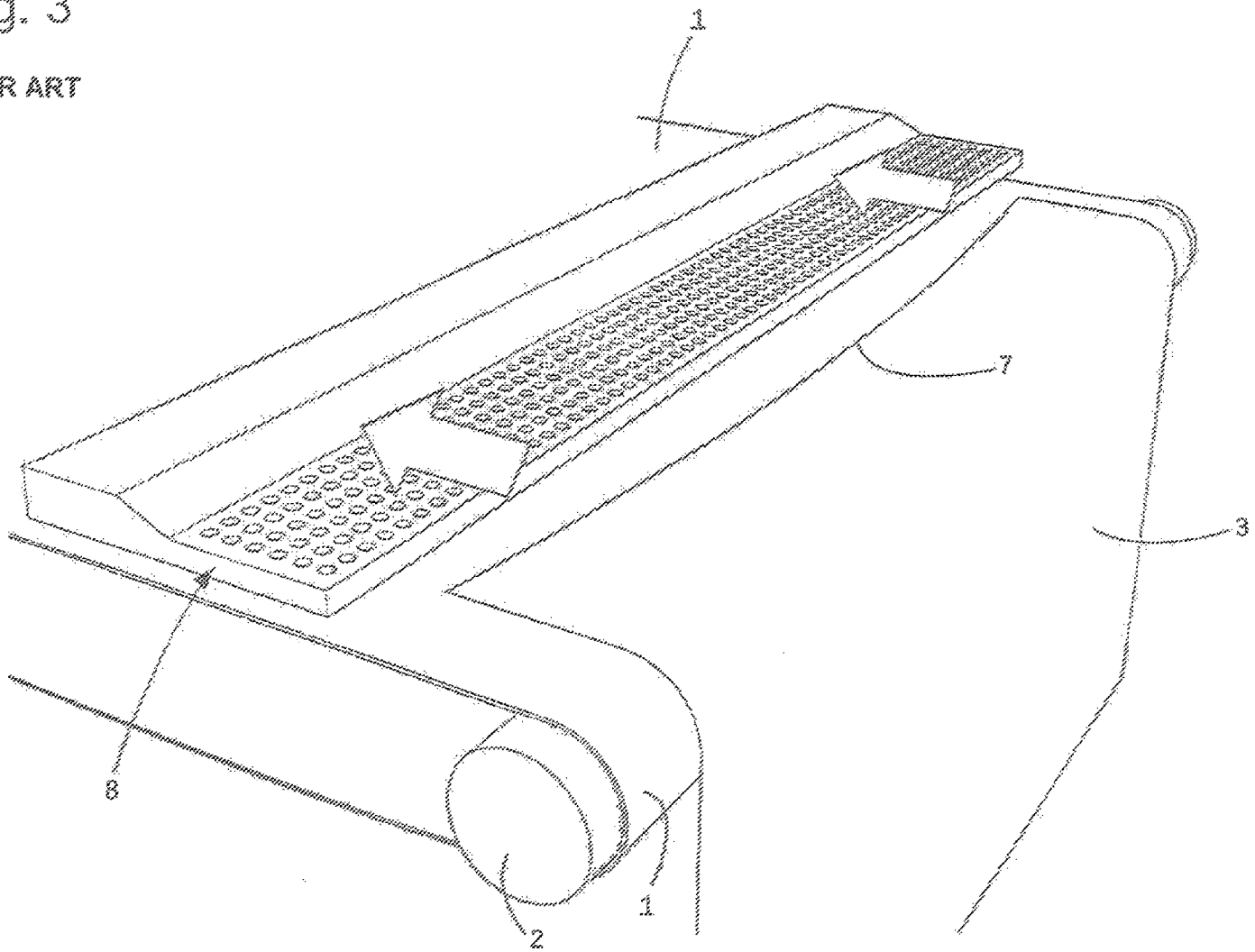
Fig. 3 PRIOR ART

FIGS. 1-3 show the essential parts of a known apparatus to which the invention is related. By 1 is shown a conveyor belt that runs around a number of rollers of which the roller 2 is seen. The function of the apparatus is to deliver a laundry item 3 to the conveyor belt 1, and, according to the prior art, it is accomplished by means of a pair of spreader clamps 4, 5 that are journalled on a machine part 6 to the effect that the clamps 4, 5 can be moved along the machine part 6 essentially transversally to the direction of conveyance of the conveyor belt 1, see the arrow in FIG. 1. The spreader clamps 4, 5 can be closed and opened (open position in FIG. 2), and the apparatus can be configured such that the spreader clamps 4, 5 receive a piece of cloth either automatically or manually. When the piece of cloth 3 is extended between the clamps 4, 5 as is shown in FIG. 1, the fore edge 7 of the piece of cloth will curve downwards due to the own weight of the clothing and the weight of the amount of water contained in the clothing. By the prior art, the piece of cloth is transferred from the position shown in FIG. 1 to the position shown in FIG. 2, where the piece of cloth 3 is supplied to a vacuum boom 8. Then the spreader clamps are opened as shown in FIG. 2 and moved completely to one side to the effect that they release the piece of cloth completely. The undesired downwardly curving shape of the fore edge 7 is thus maintained when the piece of cloth has been handed over to the vacuum boom 8.

The above explanation of the downwardly curving fore edge 7 of the piece of cloth is slightly simplified in relation to FIGS. 1-3. In reality, the highest load due to the weight of the clothing will occur between the tips of the spreader clamps, which is, however, difficult to illustrate. By the clamps in FIG. 1 being forcefully influenced to move away from each other, the fore edge 7 can straightened almost simultaneously with the clothing between the tips of the clamps still curving downwards, and this will cause the fore edge 7 to still curve when the clothing has been deposited onto the conveyor belt. It will also be understood that the position of the clamps relative to the horizontal is of consequence. The above detailed explanation is most relevant in the context of horizontal clamps, while the explanation given in relation to FIGS. 1-3 suffices when the clamps point vertically downwards.

Therefore, the present invention generally speaks of the shape of the fore edge of the piece of cloth, albeit the problem concerns the complete piece of cloth that is situated between the clamps and in particular between the tips of the clamps.

FIG. 3 will show (for the sake of clarity the spreader clamps are not shown) that the vacuum boom 8 is moved rearwards, see the shown arrows, by which the piece of cloth is deposited onto the belt 1, the vacuum in the vacuum boom 8 being relieved at some point. Therefore, the prior art entails that the curved shape of the fore edge 7 still exists when the piece of cloth 3 is advanced by means of the conveyor belt 1, typically to a rotary ironer. Therefore, the fully ironed clothing will also have that inexpedient shape, and the major drawback manifests itself later, when the clothing is folded in an automated process. The curved edges will reveal an unfinished and unprofessional laundry result.

Figure 4:
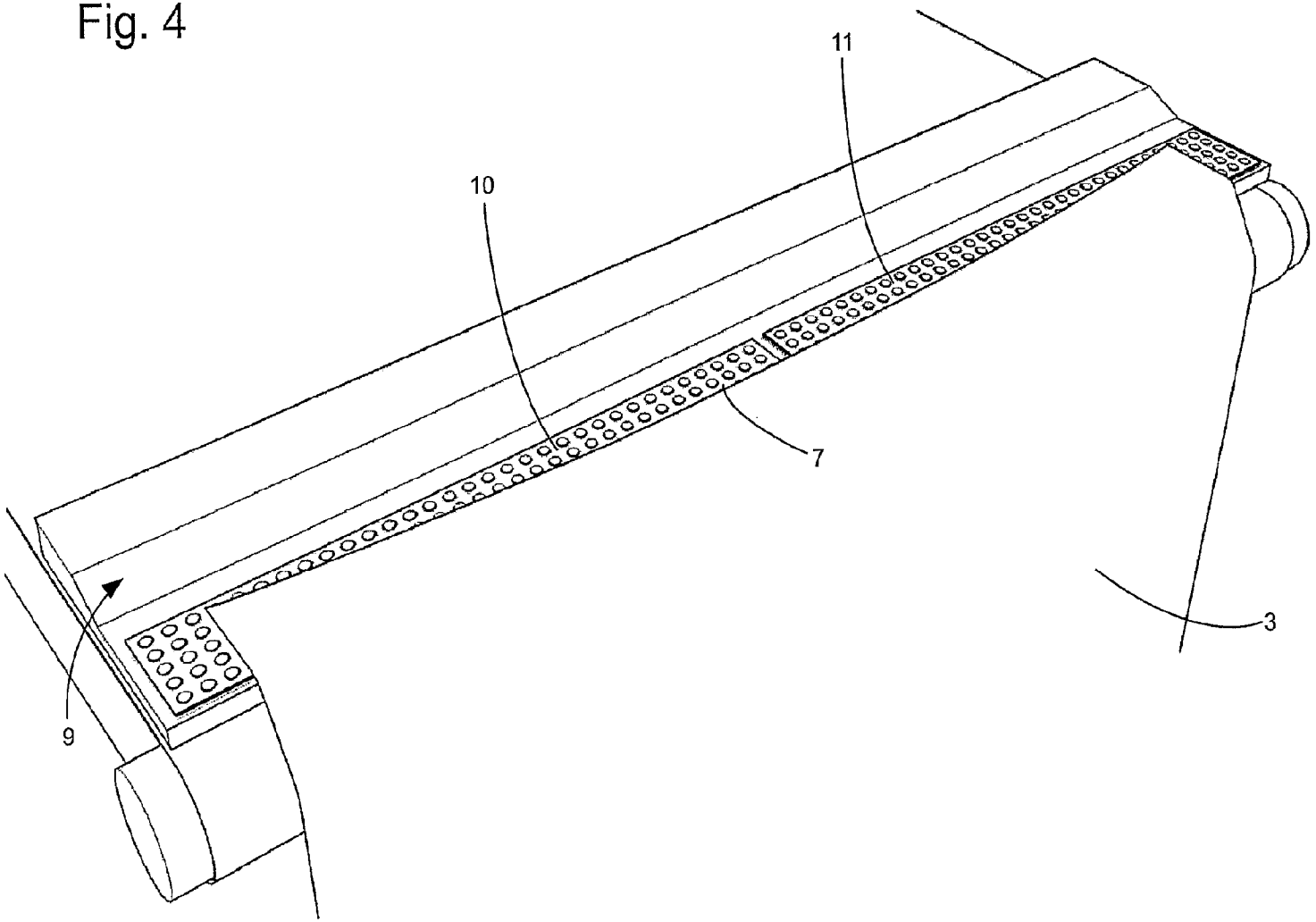
FIGS. 4 and 5 show a first embodiment of the apparatus according to the invention.
Figure 5:
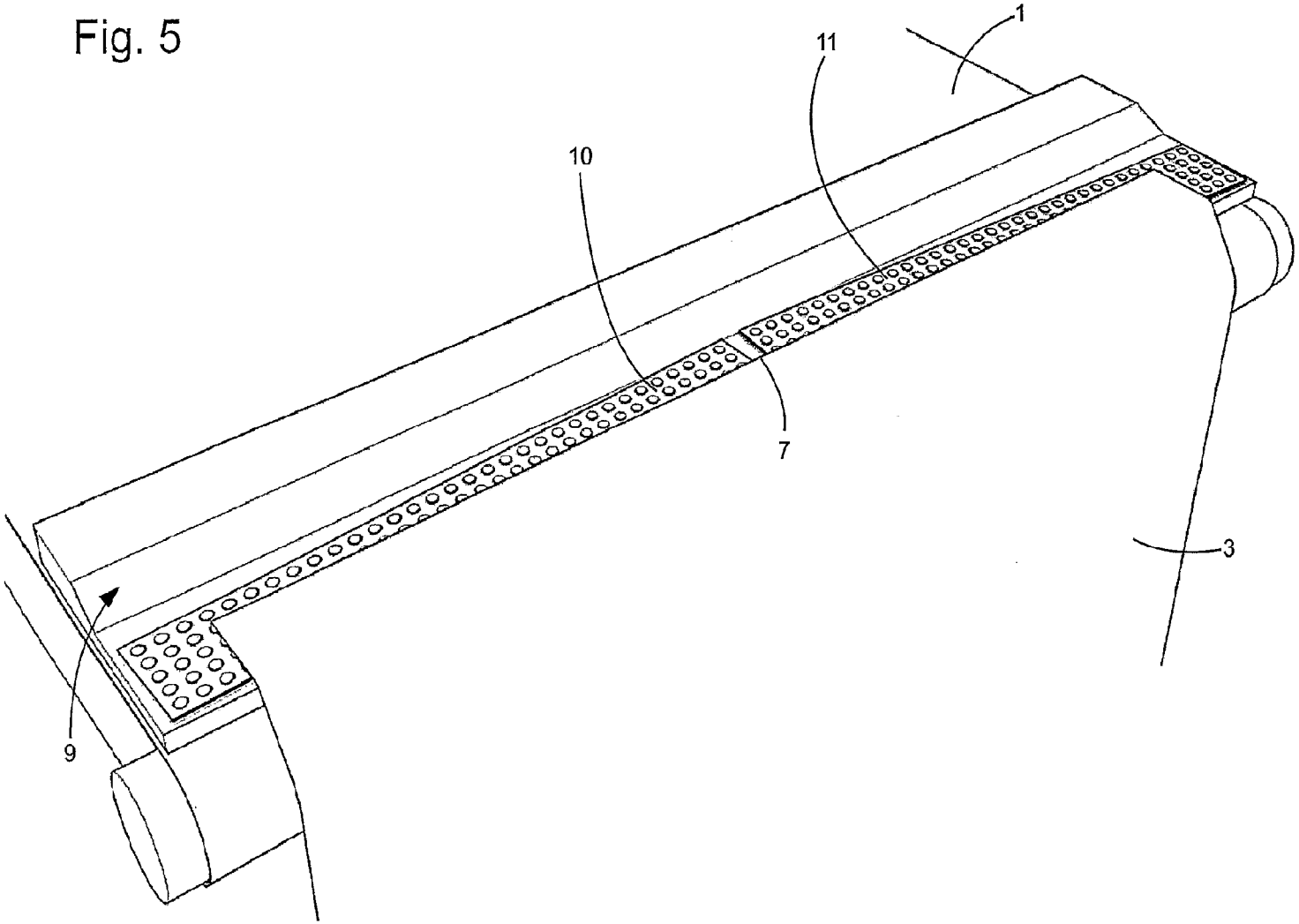

FIGS. 4 and 5 show a first embodiment of an apparatus according to the invention where, instead of the vacuum boom 8 described above, a transverse boom 9 is provided which is provided with a pair of support areas in the shape of perforated sheets 10, 11. The perforated sheets 10, 11 are pivotally journalled at their respective outer ends, and actuator means are provided that are configured to shift the ends of the perforated sheets 10, 11 that face towards each other as will be explained in further detail in the context of FIGS. 6A and B. The fore edge 7 of the piece of cloth 3 has the same inexpedient shape in FIG. 4 as was shown in FIG. 2, but the perforated sheets 10, 11 being, according to the invention, able to turn to the position shown in FIG. 5, the fore edge 7 can be aligned to be completely straight. When, at a later stage, the transverse boom 9 is moved back in the same manner as described in the context of FIG. 3, the piece of cloth 3 will be supplied onto the conveyor belt 1 with a straight fore edge 7 or an approximately straight fore edge. The final shape will depend on how many sections of perforated sheets that are provided and how they are controlled relative to each other; see the embodiments described at a later stage. First, in the context of FIGS. 6A and 6B, a number of details of the embodiment shown in FIGS. 4 and 5 will be explained.

Figure 6A:
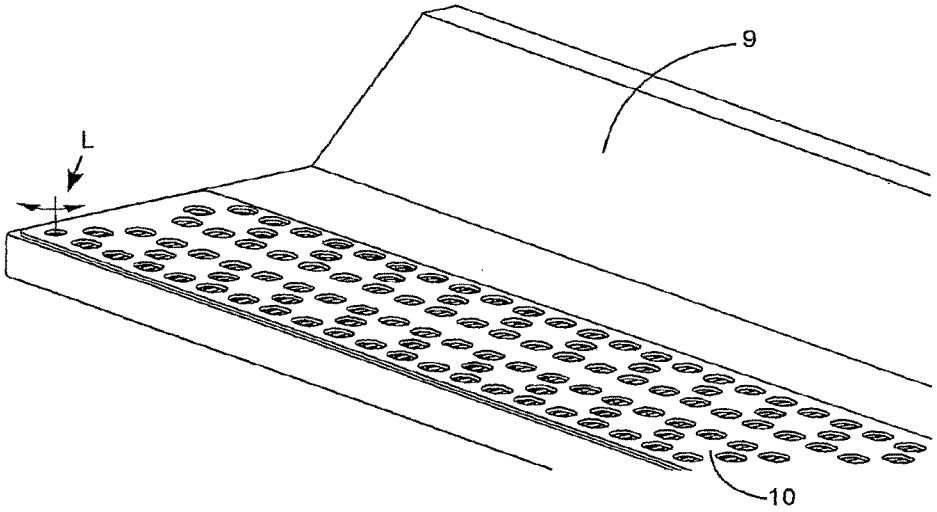
FIGS. 6A and 6B show details of the embodiment shown in FIGS. 4 and 5.
Figure 6B:
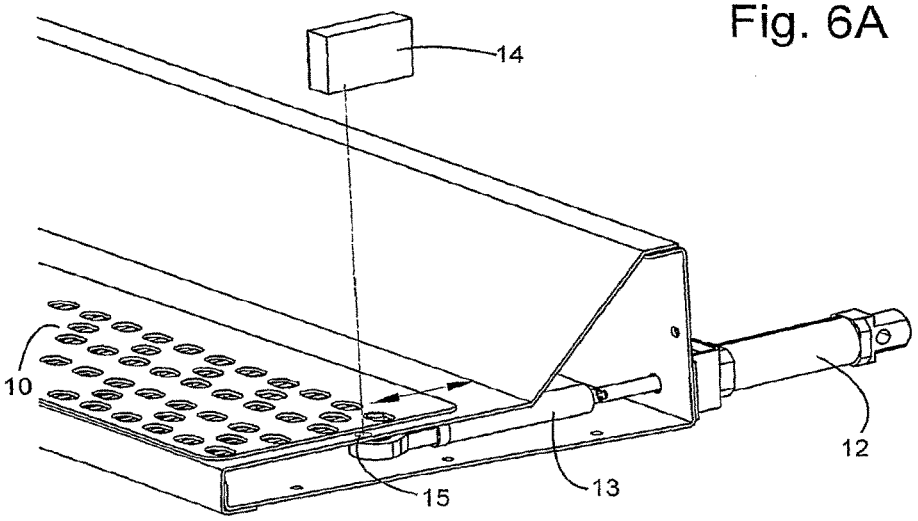

FIG. 6A shows the transverse boom 9, and more specifically that end where the perforated sheet is journalled, which is shown by L. The opposite end of the same perforated plate 10 will appear from FIG. 6B which also shows a drive mechanism for moving the perforated plate 10 back and forth. The drive mechanism comprises a pneumatic cylinder 12 that drives an actuator arm 13 connected to the perforated sheet 10 via a free clearance in the transverse boom 9. FIG. 6 further shows a detector 14 configured for receiving light from a light source 15 which is situated between the perforated plates 10 and 11. The location is configured such that the detector 14 is able to receive light from the light emitter 15 when the clothing is situated on the perforated sheets 10, 11 as shown in FIG. 4. In that case, propellant air is supplied to the cylinder 12 to the effect that the perforated sheets 10, 11 are moved to the position shown in FIG. 5 where the fore edge 7 is straightened, and where the clothing precisely blocks the light beam from the light emitter 15 to the detector 14. It will be understood that the perforated sheet 11 can be driven by a separate cylinder identical to the cylinder 12; or that the cylinder 12 can also be configured to operate both perforated sheets.

Figure 7:
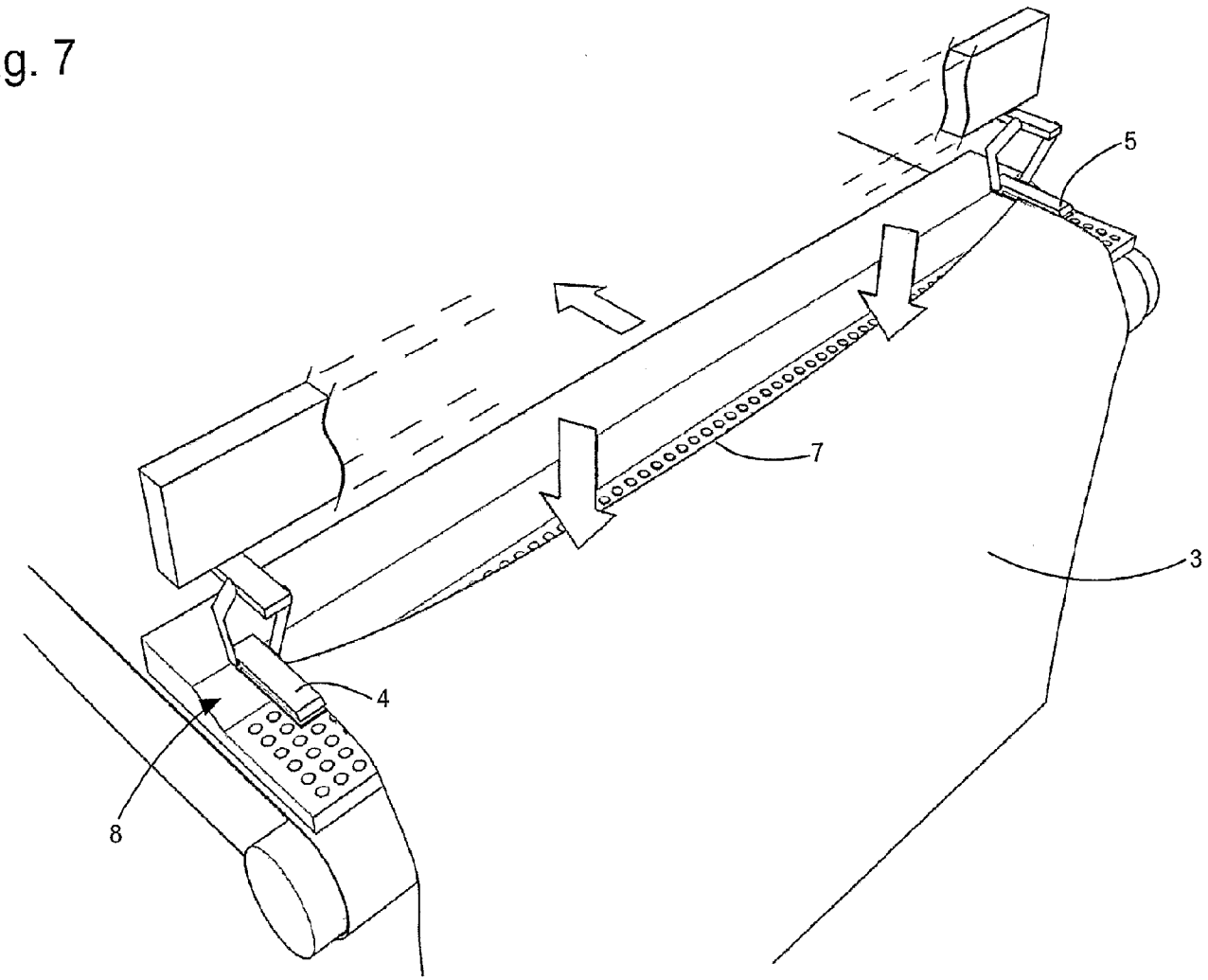
Figure 8:
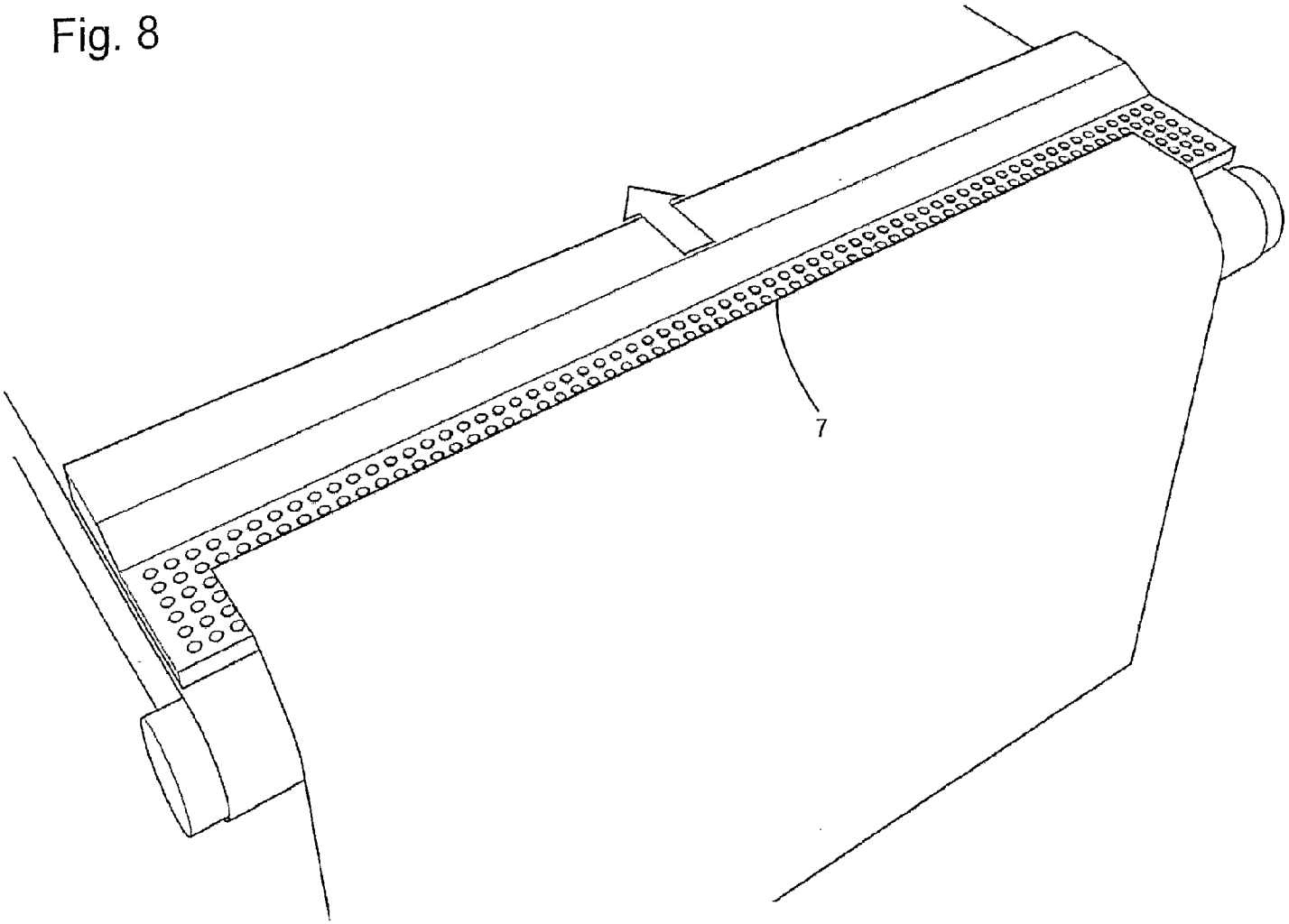

Another apparatus for exercising the invention is shown in FIGS. 7 and 8, wherein the same perforated sheet 8 can be used as is shown in FIGS. 1-3. By the embodiment shown in FIGS. 7 and 8, the fore edge 7 is aligned by the vacuum boom 8 being moved rearwards (see the arrow) simultaneously with the clothing being deployed (see the arrows) on the vacuum boom 8 by means of the clamps 4, 5. By the piece of cloth 3 being deployed gradually towards the vacuum boom 8, while simultaneously the latter is conveyed backwards, the fore edge 7 could end up with a completely rectilinear course which is shown in FIG. 8 without the vacuum boom having to be modified from a technical point of view. In practice, the described pattern of movement requires a control unit in which a control program is stored that defines the mutual patterns of movement of the movable parts. Such control programs may comprise everything from a simple linear pattern of movement to complex patterns of movement that depend on one or more detectors and/or manual adjustment options on the apparatus.

It will be understood that the mutually shifting in time of parts in accordance with the embodiment shown in FIGS. 7 and 8 can be combined with the machine parts described in the context of FIGS. 4 and 5, and to further describe the many options that are entailed by the invention, FIGS. 9-13 show further embodiments of the invention.

Figure 9:
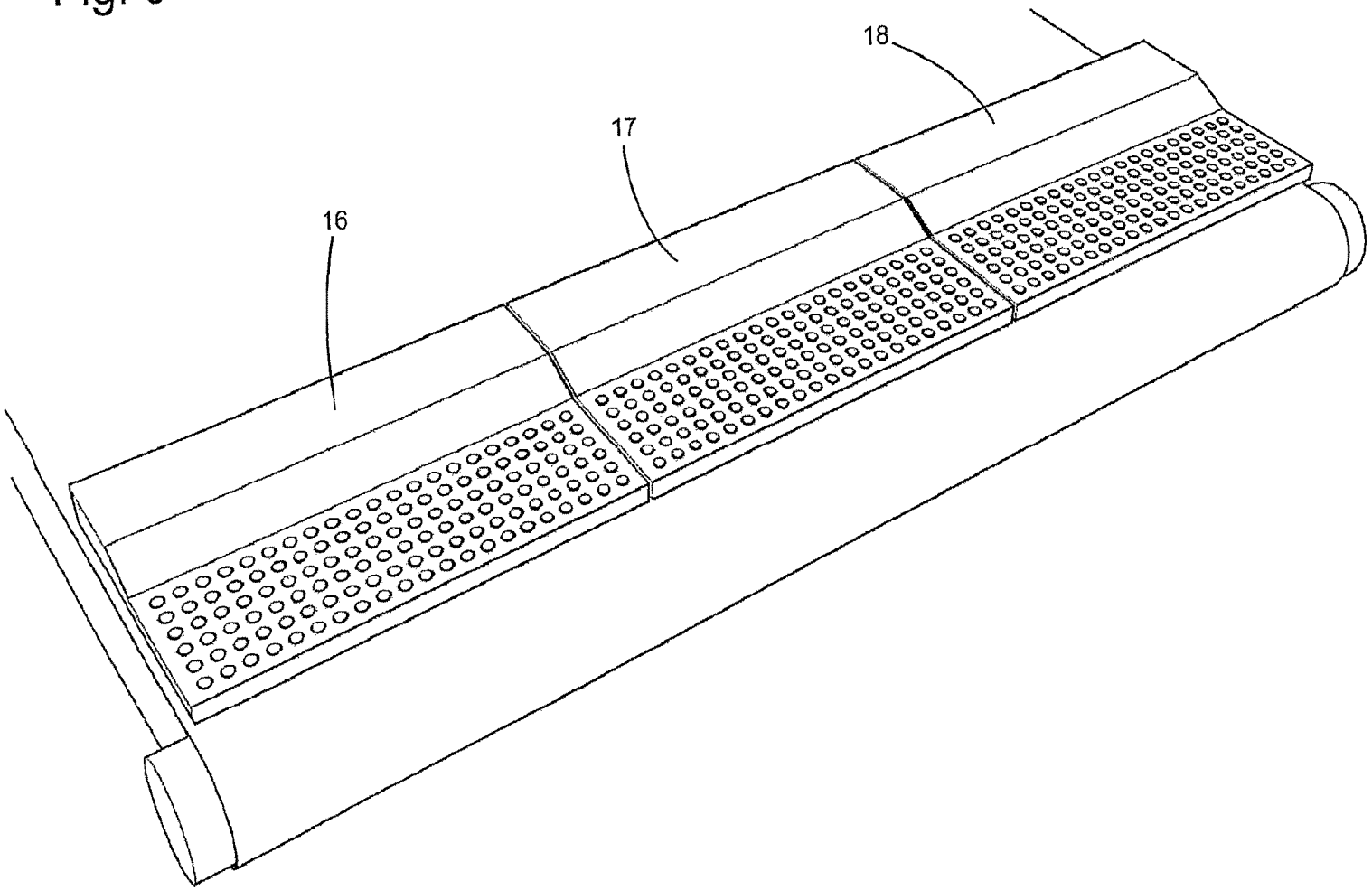
FIGS. 9-14 show further examples of embodiments according to the invention.
Figure 10:
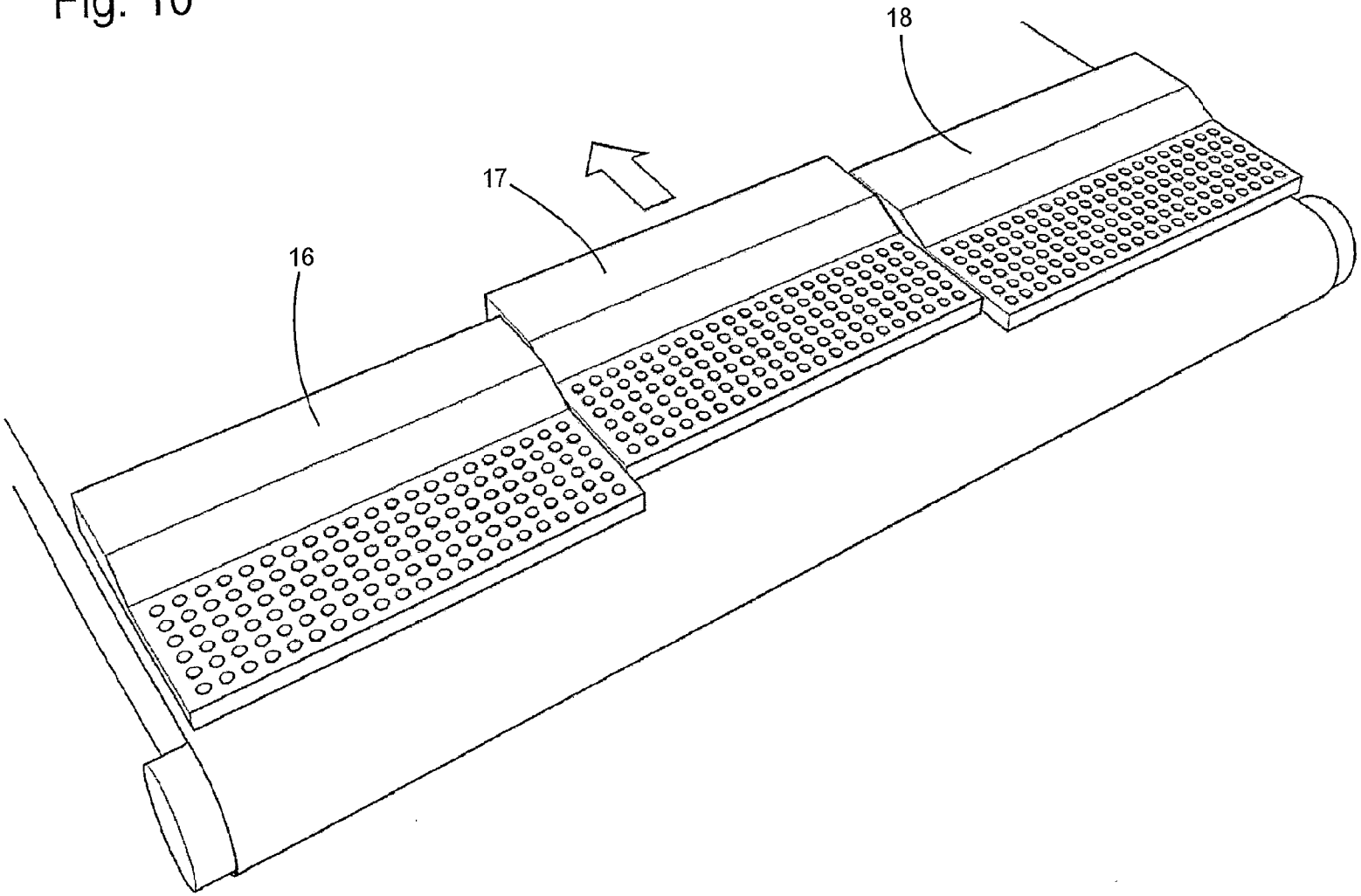
Figure 11:
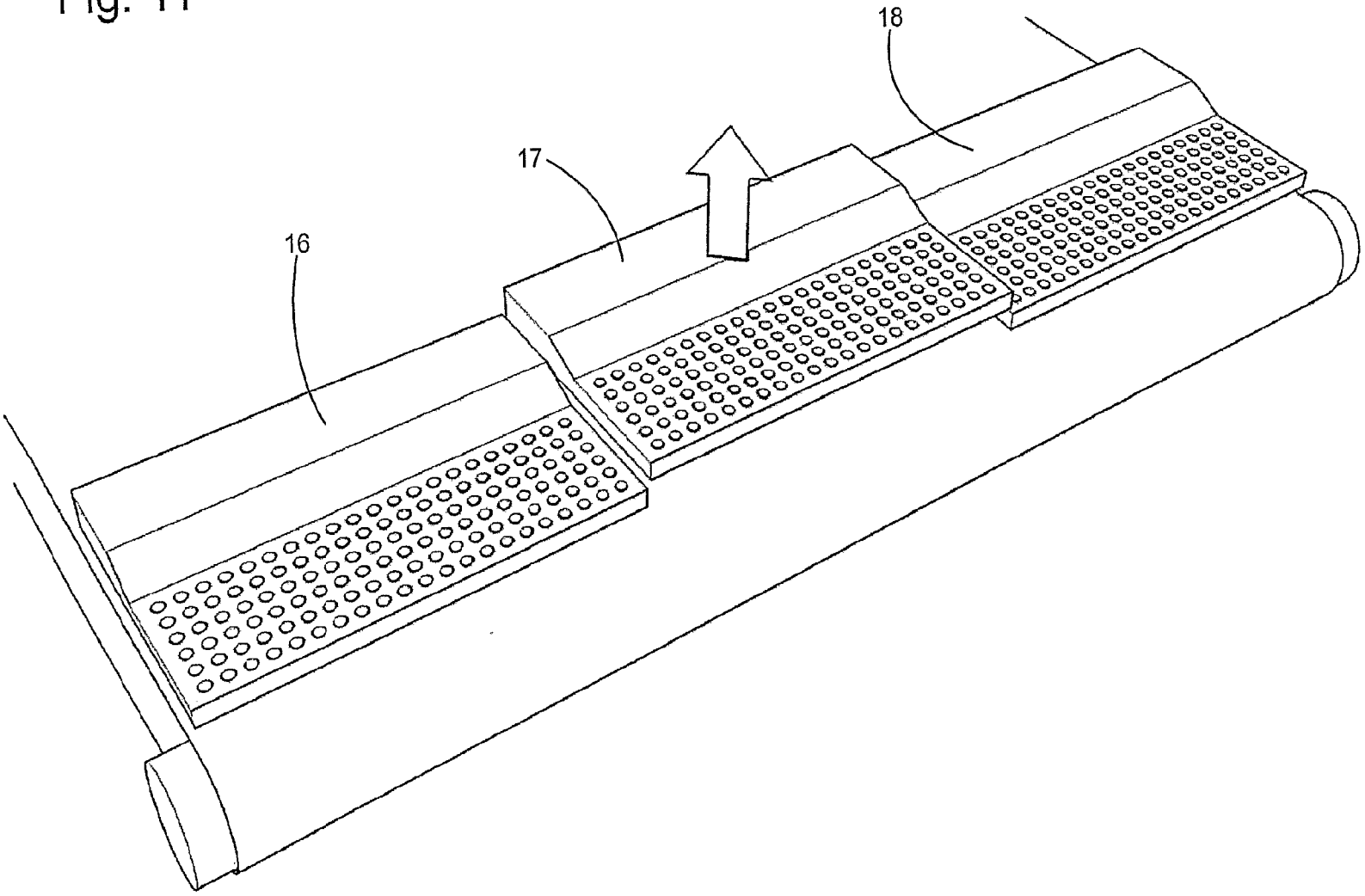

By the embodiment shown in FIG. 9, a vacuum boom is provided which is divided into three sections 16, 17, 18. As will appear from FIG. 10, the section 17 is configured for being movable in the direction of the arrow relative to sections 16 and 18. Section 17 may alternatively be configured to be movable as shown by the arrow in FIG. 11 for straightening the curve of the fore edge 7 of the piece of cloth 3. It will be understood that the sections 16-18 shown in FIGS. 10 and 11 are—apart from being movable relative to each other—also configured for being moved in unison in order for them to deliver the piece of cloth 3 to the conveyor belt 1 as is shown and explained in the context of FIG. 3.

Figure 12:
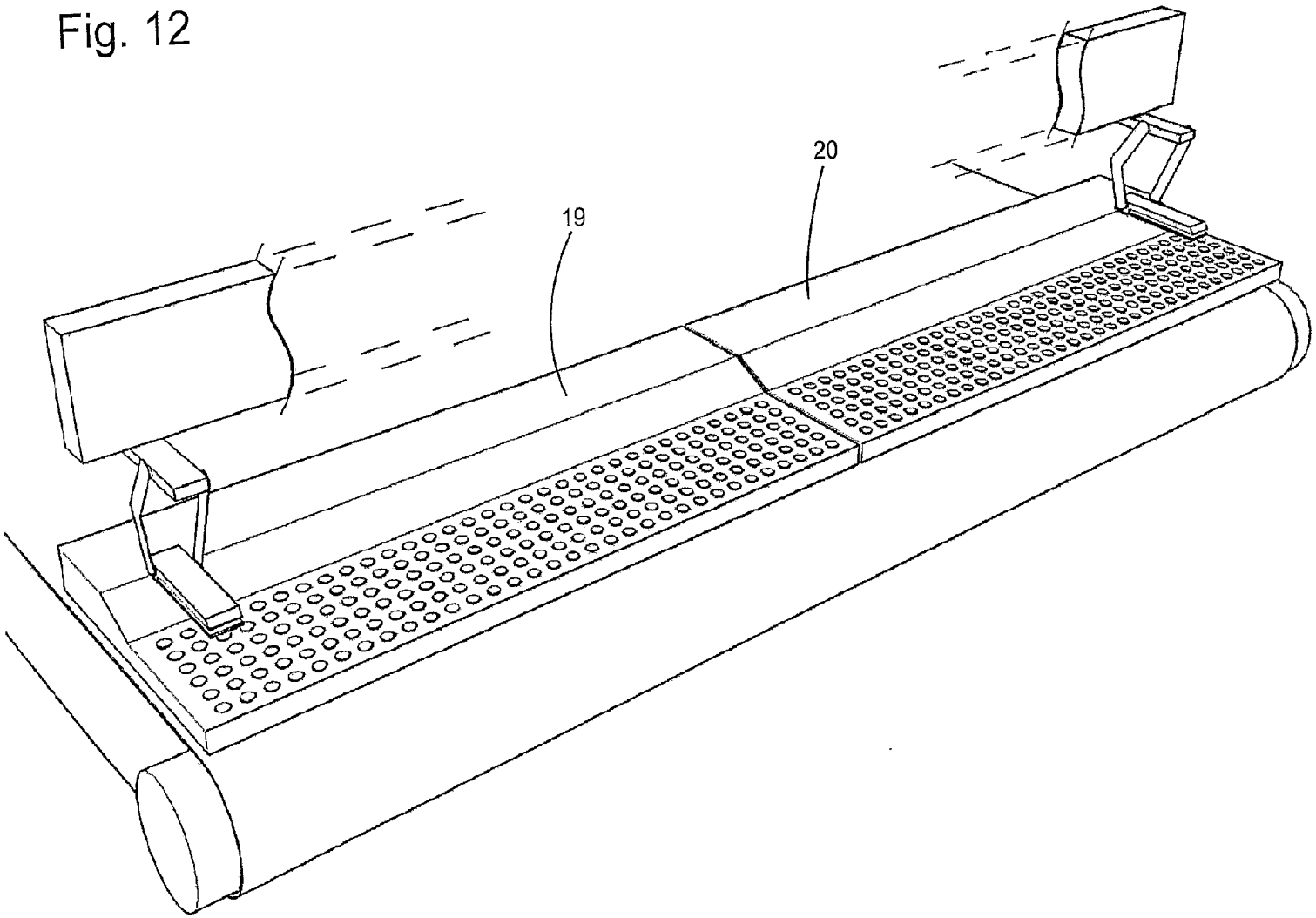
Figure 13:
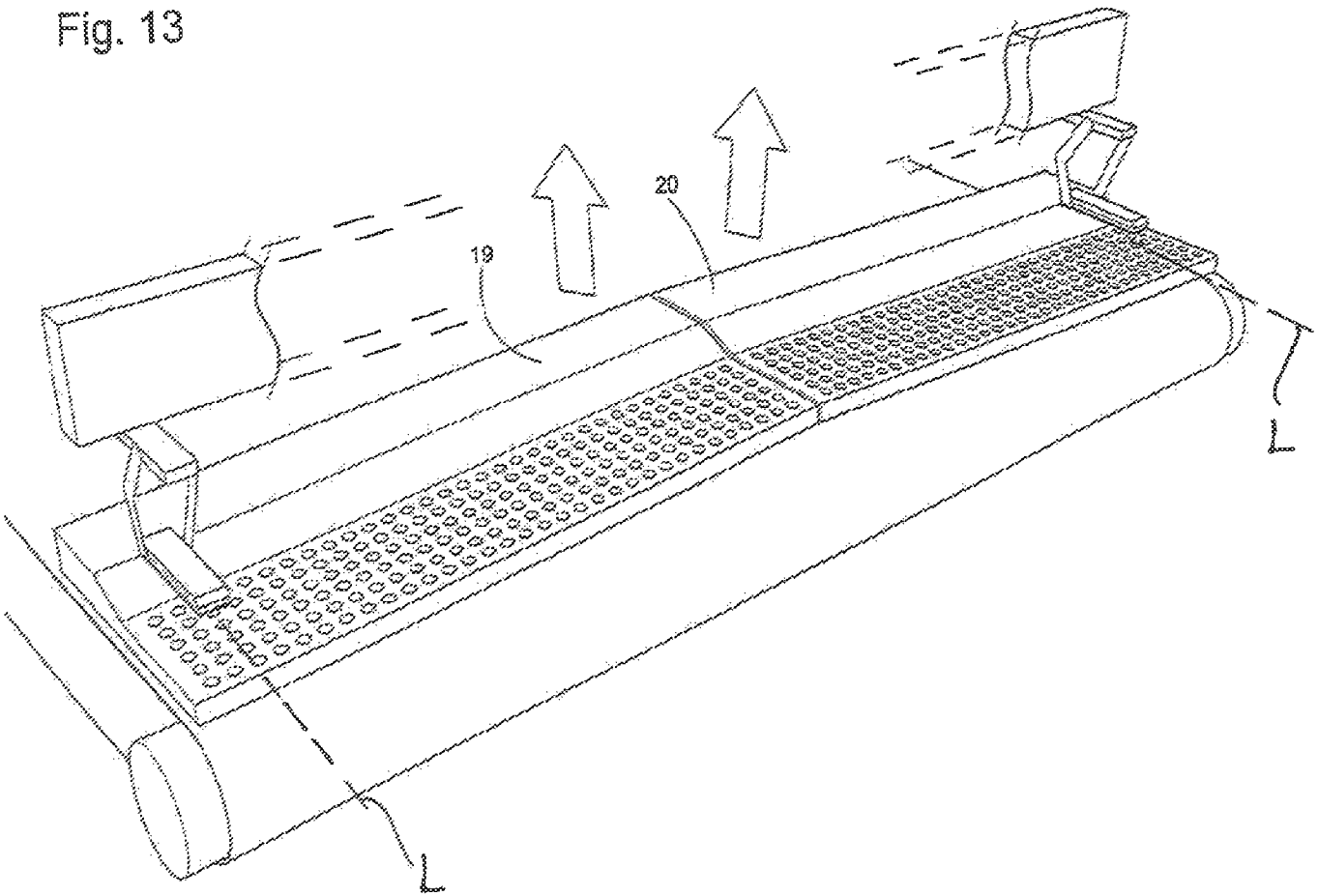
Figure 14:
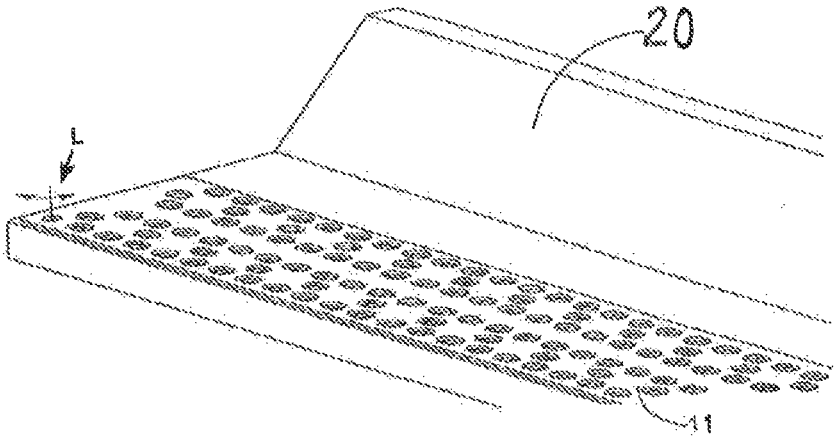

FIGS. 12 and 13 show a further embodiment where vacuum sections 19, 20 are configured to be movable relative to each other as is shown by the arrows in FIG. 13. It will readily be understood that it is possible to thereby rectify the disadvantageous shape of the fore edge 7. It will also be understood that the more sections are provided, the straighter a correction can be made. An ideal scenario is when a perforated sheet is used that can be curved evenly with a view to an even straightening of the downward curve of the fore edge 7 of the piece of cloth 3. It will also be understood that the other embodiments shown in FIGS. 7-13 and others can be supplemented with one or more detectors, see the detector 14, 15 in FIG. 6B. FIG. 14 illustrates another embodiment where perforated plates of FIG. 5 are journaled at an inner end thereof. FIG. 13 also shows a line denoted L to show a (near horizontal) axis about which the perforated plates are turned. Thereby it is possible to emit control signals to an electronic control circuit which is configured for controlling the mutual movement of the described machine parts.

The invention claimed is:

1. A laundry apparatus comprising:

a conveyor having a conveyance direction;

a transverse boom extending transversely to the conveyance direction above said conveyor, the transverse boom including a support area having at least two planar surfaces moveable relative to one another; and a pair of spreader clamps moveable away from each other and traverse to the conveyance direction, the pair of spreader clamps being configured to receive a pair of adjacent corners of a piece of cloth and release the piece of cloth to the conveyor;

wherein each of said at least two planar surfaces is a perforated plate journaled at an end thereof such that when turned they will form the tip of a V where they meet, said plates being rotatable about a respective axis, said axes being parallel to each other, said plates being configured to contact the piece of cloth released from the spreader clamps for straightening a fore edge of said cloth by said relative movement, further comprising a vacuum configured to temporarily retain the piece of cloth on the support area.

2. The laundry apparatus according to claim 1, wherein said axes are vertical.

3. A laundry apparatus comprising:

a conveyor having a conveyance direction;

a transverse boom extending transversely to the conveyance direction above said conveyor, the transverse boom including a support area having at least two surfaces, wherein at least one of the at least two surfaces is moveable into and out of parallel alignment with a top surface of the conveyor; and a pair of spreader clamps moveable away from each other and traverse to the conveyance direction, the pair of spreader clamps being configured to receive a pair of adjacent corners of a piece of cloth and release the piece of cloth to the conveyor;

wherein each of said at least two planar surfaces is a perforated plate journaled at an end thereof such that when turned they will form the tip of a V where the meet, said plates being rotatable about a respective axis, said axes being parallel to each other, said plates being configured to contact the piece of cloth released from the spreader clamps for straightening a fore edge of said cloth by said relative movement.

4. A laundry apparatus comprising:

a conveyor having a conveyance direction;

a transverse boom extending transversely to the conveyance direction, the transverse boom including a support area;

a pair of spreader clamps moveable away from each other and traverse to the conveyance direction, the pair of spreader clamps being configured to receive a pair of adjacent corners of a first piece of cloth and a second piece of cloth and release the first and second pieces of cloth to the conveyor;

a controller configured to control the movement of the transverse boom and the pair of spreader clamps according to a first time dependent pattern of movement for the first piece of cloth and a second time dependent pattern of movement for the second piece of cloth, wherein the first and second time dependent patterns of movement are different from each other;

wherein the support area includes a surface configured to contact the first and second pieces of cloth released from the spreader clamps, further comprising a detector configured to detect a shape of a fore edge of the first and second pieces of cloth, wherein the first and second time dependent patterns of movement are based on the detected shapes of the fore edges of the respective first and second pieces of cloth.

5. A laundry apparatus comprising:

a conveyor having a conveyance direction;

a transverse boom extending transversely to the conveyance direction, the transverse boom including a support area;

a pair of spreader clamps moveable away from each other and traverse to the conveyance direction, the pair of spreader clamps being configured to receive a pair of adjacent corners of a first piece of cloth and a second piece of cloth and release the first and second pieces of cloth to the conveyor;

a controller configured to control the movement of the transverse boom and the pair of spreader clamps according to a first time dependent pattern of movement for the first piece of cloth and a second time dependent pattern of movement for the second piece of cloth, wherein the first and second time dependent patterns of movement are different from each other;

wherein the support area includes a surface configured to contact the first and second pieces of cloth released from the spreader clamps wherein the controller is further configured to determine the first and second time dependent patterns of movement based on at least one of an elasticity of the respective first and second pieces of cloth, a weight of the respective first and second pieces of cloth, and an amount of water absorbed by the respective first and second pieces of cloth.

6. A laundry apparatus comprising:

a conveyor having a conveyance direction;

a transverse boom extending transversely to the conveyance direction above said conveyor, the transverse boom including a support area having at least two planar surfaces moveable relative to one another; and a pair of spreader clamps moveable away from each other and traverse to the conveyance direction, the pair of spreader clamps being configured to receive a pair of adjacent corners of a piece of cloth and release the piece of cloth to the conveyor;

wherein each of said at least two planar surfaces is a perforated plate journaled at an end thereof, said plates being rotatable about a respective axis, said axes being parallel to each other, said plates being configured to contact the piece of cloth released from the spreader clamps for straightening a fore edge of said cloth by said relative movement, further comprising a vacuum configured to temporarily retain the piece of cloth on the support area, wherein each perforated plate is journaled at an outer end thereof.

7. A laundry apparatus comprising:

a conveyor having a conveyance direction;

a transverse boom extending transversely to the conveyance direction above said conveyor, the transverse boom including a support area having at least two planar surfaces moveable relative to one another; and a pair of spreader clamps moveable away from each other and traverse to the conveyance direction, the pair of spreader clamps being configured to receive a pair of adjacent corners of a piece of cloth and release the piece of cloth to the conveyor;

wherein each of said at least two planar surfaces is a perforated plate journaled at an end thereof, said plates being rotatable about a respective axis, said axes being parallel to each other, said plates being configured to contact the piece of cloth released from the spreader clamps for straightening a fore edge of said cloth by said relative movement, wherein each perforated plate is journaled at an outer end thereof.

* * * * *